United States Patent [19]

Johnston et al.

[11] Patent Number: 4,864,915

[45] Date of Patent: Sep. 12, 1989

[54] VACUUM OPERATED ACTUATOR

[75] Inventors: Daniel U. Johnston, Nokomis, Fla.; Richard A. Zirnheld, Lockport, N.Y.

[73] Assignee: General Motors Corporation, Detroit, Mich.

[21] Appl. No.: 205,962

[22] Filed: Jun. 13, 1988

[51] Int. Cl.[4] ..... F15B 9/10

[52] U.S. Cl. ..... 91/376 R; 91/383; 91/454

[58] Field of Search ..... 60/397; 91/376 R, 454, 91/383, 368

[56] References Cited

U.S. PATENT DOCUMENTS

| | | | |
|---|---|---|---|
| 1,811,994 | 6/1931 | Bragg et al. | 60/397 |
| 1,848,923 | 3/1932 | Almen | 91/376 |
| 1,865,817 | 7/1932 | Berry | 91/376 X |
| 2,738,157 | 3/1956 | Vargo | 251/30 |
| 2,880,706 | 4/1959 | Price | 91/376 |
| 2,897,789 | 8/1959 | Rosback | 91/376 |
| 3,023,996 | 3/1962 | Robertson | 251/14 |
| 3,461,908 | 8/1969 | Newcomb et al. | 137/492.5 |
| 3,590,859 | 7/1971 | Gotzenberger et al. | 137/495 |
| 3,670,757 | 6/1972 | Quain | 137/103 |
| 3,828,743 | 8/1974 | Ludwig | 123/117 |
| 3,933,166 | 1/1976 | Gould et al. | 137/102 |
| 3,982,553 | 9/1976 | Johnston et al. | 137/81 |
| 3,982,555 | 9/1976 | Aubel et al. | 137/103 |
| 4,191,090 | 3/1980 | Freiberger et al. | 91/52 |
| 4,366,831 | 1/1983 | Scott | 137/103 |
| 4,453,563 | 6/1984 | Walters | 137/414 |
| 4,480,657 | 11/1984 | Marshall et al. | 137/103 |

*Primary Examiner*—Edward K. Look
*Attorney, Agent, or Firm*—R. L. Phillips

[57] ABSTRACT

A vacuum operated actuator has a spring biased diaphragm that is exposed on one side to atmosphere and on the other side to a vacuum chamber. An output means is connected to move with the diaphragm and carries a valve means which together with a tube a manually controlled tube operates to connect the vacuum chamber with either atmosphere or with a vacuum source so that the diaphragm and thereby the output moves with the movement and in the direction of the tube so as to provide an output force so as to move the output with a force substantially greater than the input force applied to the tube.

3 Claims, 2 Drawing Sheets

VACUUM OPERATED ACTUATOR

TECHNICAL FIELD

This invention relates to vacuum operated actuators and more particularly to one providing a variable positional output with minimum input control force.

BACKGROUND OF THE INVENTION

In systems such as motor vehicle air conditioning, heating and ventilating systems, one or more doors used therein to control air flow can require several pounds of force to effect their movement to a variable position. A Bowden wire because of its flexibility for ease of circuiting is generally desired for effecting this air door movement. However, the manual control force that is required can be prohibitive as it is desirous for example to not let such manual force exceed one pound.

SUMMARY OF THE INVENTION

The present invention offers a solution to this force problem with a vacuum operated actuator having a spring biased diaphragm that is exposed on one side to atmosphere and on the other side cooperates with a housing to define a vacuum chamber. A Bowden wire is connected to move a tube to control connection between the vacuum chamber and either atmosphere or a vacuum source via connection through the tube. A valve normally closes both an exhaust port to atmosphere and also an otherwise open end of the tube whose interior is connected to the vacuum source. When the tube is moved away from the valve, the tip thereof is opened to the vacuum chamber to evacuate same by way of the interior of the tube. Atmospheric pressure then pushes the diaphragm compressing its spring and supplying the force required to move the air door through a connector secured to the center of the diaphragm and with the diaphragm continuing to move the air door until the valve again seals off the tip of the tube to position the air door in the desired position. Alternatively, when the tube is moved by the Bowden wire in the opposite direction, the valve is unseated to open to vent the vacuum chamber to atmosphere. As a result, there is then less atmospheric pressure acting on the diaphragm so that the spring then moves the diaphragm until the valve again closes the exhaust port to atmosphere to position the air door in the desired position.

An object of the present invention is to provide a new and improved vacuum operated actuator having a variable positional output with a force that far exceeds the input control force to the actuator.

Another object is to provide a vacuum operated actuator having a spring biased diaphragm that is exposed on one side to atmosphere and on the other side to a vacuum chamber and is connected to an output and whose movement is controlled to follow a manual input by a valve on the output that controls communication between the vacuum chamber and either a vacuum source or atmosphere.

Another object is to provide a vacuum operated actuator having a spring biased diaphragm that is connected to an output and is exposed on opposite sides to atmosphere and a vacuum chamber and wherein the vacuum chamber is caused to communicate with either atmosphere or a vacuum source by a control tube that is operated by a Bowden wire and cooperates with a valve is carried on the output.

These and other objects, advantages and features of the present invention will become more apparent from the following description and drawing in which.

Figure 1:
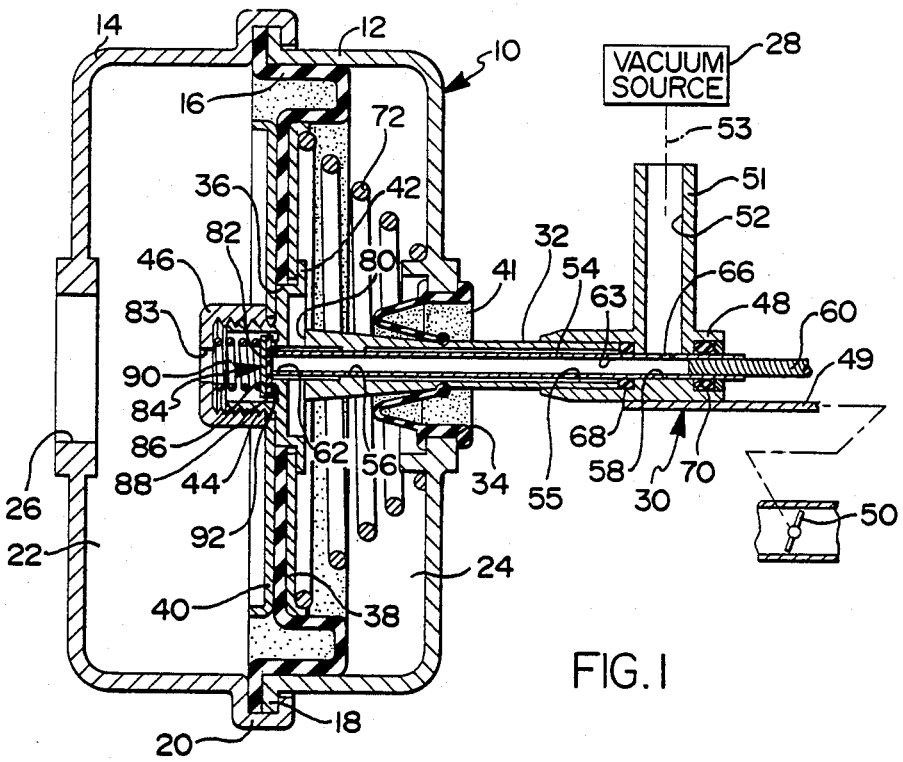
FIG. 1 is a sectional view of a vacuum operated actuator according to the present invention when in its normal non-activated condition.

Referring to FIG. 1 of the drawing, there is shown a vacuum operated actuator 10 comprising a pair of cup-shaped housing parts 12 and 14 and a piston preferably in the form of a diaphragm 16 whose outer periphery is sandwiched by a radial flange 18 on the housing part 12 that is gripped by a crimped flange 20 on the other housing part 14. The diaphragm 16 extends across the interior of the housing defined by the two parts 12 and 14 and divides the interior therein into an atmospheric chamber 22 and a vacuum chamber 24. The chamber 22 is open to the atmosphere through a central opening 26 in the housing part 14 and the vacuum chamber 24 is openable to either the atmosphere or to a vacuum source or supply 28 such as a motor vehicle's engine intake manifold.

An output means 30 is fixed to the center of the diaphragm 16 for movement therewith and extends outwardly of the housing and comprises a hollow column 32 which extends through an opening 34 in the housing part 12 and through a central opening 36 in both the diaphragm 16 and similar openings in reinforcement plates 38 and 40 which sandwich the diaphragm. A bellows type seal 41 provides sealing of the housing opening 34 between the output column 32 and the housing part 12. The column 32 is secured to the diaphragm and reinforcement plate assembly and also clamps such together by a shoulder 42 thereon that contacts the reinforcement plate 38 and by being threaded at its left end at 44 to receive a female threaded fastener 46. The fastener 46 contacts the other reinforcement plate 40 and together with the shoulder 42 clamp the column 32 to the center of the diaphragm. Moreover, the fastener 46 also serves as a valve housing as will be described in more detail later.

The output means 30 further comprises a fitting 48 that is fixed to the right end of the column 32 and has a connector link 49 fixed thereto by which the output means is connected to position a pivotal air door 50 in a motor vehicle air duct system. In addition, the fitting 48 has a transversely extending nipple 51 having a vacuum passage 52 extending therethrough that is connected with the vacuum source 28 via a hose 53 shown schematically.

A tube 54 is slidably mounted in a bore 55 extending centrally through the output means 30, such tube being so slidably reported by a reduced diameter land 56 in column 32 and by a small bore 58 in the fitting 48 that intersects with the vacuum passage 52. A Bowden wire 60 is connected to the right end of the tube 54 to thus close same though it will be understood that this end of the tube could be closed by a separate closure member. The other end or tip 62 of the tube opens to the tube's interior 63. And the tube interior 63 is continuously open to the vacuum supply passage 52 by a radial port 66 in the tube that remains open to such passage within a prescribed range of tube movement as will be further discussed later and is sealed axially by a pair of O-rings 68 and 70 received in the fitting 48 on opposite sides of the passage 52.

Figure 3:
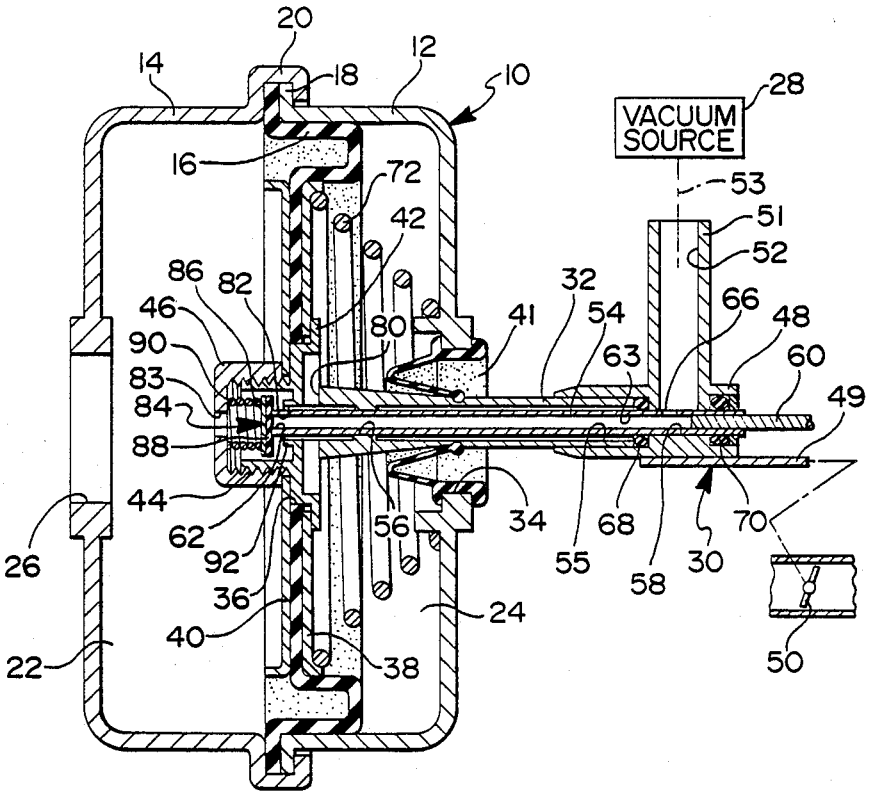
FIG. 3 is a view similar to FIG. 1 but showing the actuator conditioned to effect leftward outward movement.

A conical coil spring 72 located about the output column 32 in the vacuum chamber 24 seats at its small diameter end on the housing part 12 and contacts at its large diameter end with the reinforcement plate 38 to normally hold the center of the diaphragm 16 and thereby the output means 30 in a non-activated position as shown in FIG. 3. And for controlling communication between the vacuum chamber 24 and either the vacuum source 28 or atmosphere, the output means 30 is further provided with a radial vacuum port 80 in the column 32 that is continuously open to the vacuum chamber 24 and with an axial exhaust port 82 in the left end of the column 32 that is continuously open to the vacuum port 80 and also openable to atmosphere via a central opening 83 in the fastener 46. Valve means 84 mounted in the fastener 46 and thus on the output means 30 and comprising a disk 86 having a rubber valve face 88 biased by a coil spring 90 normally closes the exhaust port 82 to atmosphere by seating the valve face 88 on a lip 92 formed about the exhaust port on the support column 32 (see FIG. 3). In the non-activated position shown in FIG. 1 with full atmospheric pressure in the vacuum chamber and the control tube tip 62 also positioned to be closed by the valve face 88, the valve means 84 thus closes the vacuum chamber 24 to both atmosphere and the vacuum source 28.

Figure 2:
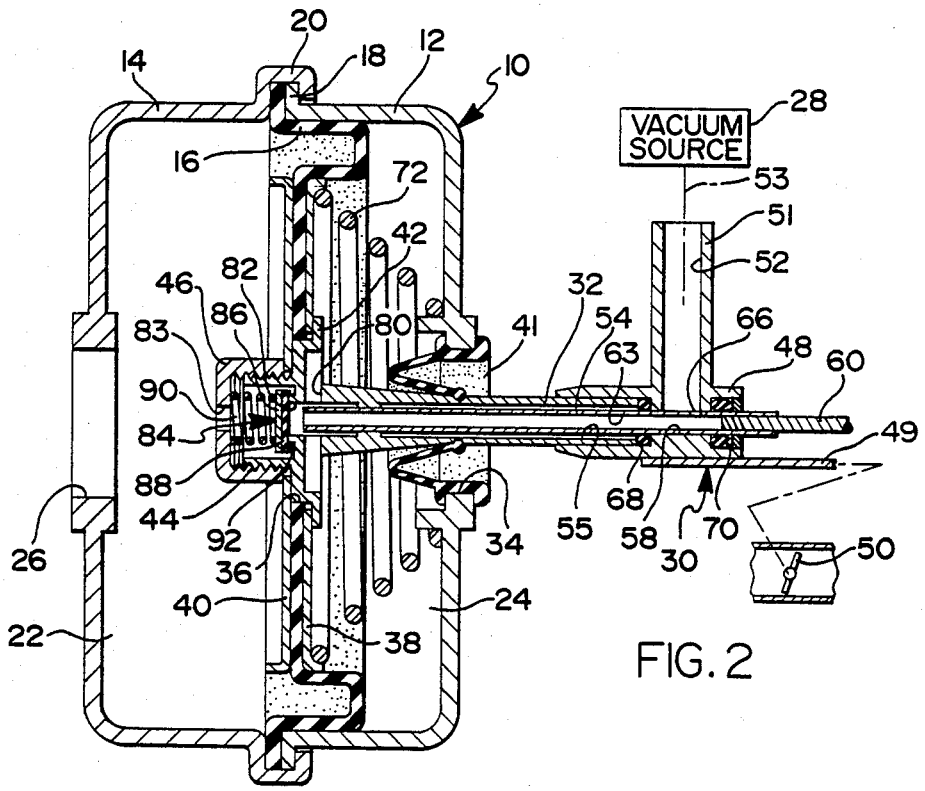
FIG. 2 is a view similar to FIG. 1 but showing the actuator conditioned to effect rightward output movement.

Describing now the operation of the vacuum operated actuator, the tube 54 is movable rightwardly by the Bowden wire 60 to a position as shown in FIG. 2 where the tube tip 62 unseats from the valve face 88 to open the tube and thereby the vacuum chamber 24 to the vacuum passage 52 via the vacuum port 80 and the tube port 66 which has moved rightwardly therewith. As a result, the vacuum chamber 24 is evacuated to allow the atmospheric pressure in chamber 22 acting on the diaphragm 16 to move same and thereby the output means 30 and connected air door 50 against the spring 72 to follow the central tube 54 until the valve means 84 again closes the open tube end 62 in addition to closing the exhaust port 82.

Alternatively, the control tube 54 is movable by the Bowden wire in the opposite or leftward direction as shown in FIG. 3 in which case the tube moves the valve means 84 to open the exhaust port 82 and thereby the vacuum chamber 24 to atmosphere via the vacuum port 80 while this valve continues to close the tube end 62. As a result, the vacuum chamber 24 is then opened to atmosphere to allow the spring 72 to move the diaphragm 16 and thereby the output means 30 and connected air door 50 to follow the central tube leftward until the valve means again closes the exhaust port in addition to closing the otherwise open tube end. Thus, it will be appreciate that in the case of rightward output movement, the only force required of the operator is that of pulling the tube while on the other hand, for leftward output movement, the only force required is that to overcome the force of the valve spring 90 which by design is far less than the force required to operate the air door.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. A vacuum operated actuator comprising a housing, piston means open on one side to the atmosphere and cooperating on the other side thereof with said housing to define a chamber, output means fixed to said piston means for movement therewith, a tube slidably mounted in said output means, said tube having an open end and a closed end, a manually operable control member fixed to said closed end for remotely effecting movement of said tube in said output means, said output means having a vacuum passage adapted to be connected to a vacuum source, a port in said tube intermediate said closed and open ends opening said vacuum passage to the interior of said tube and thereby to said open end, spring means for normally holding said piston means and thereby said output means in a non-activated position, said output means having a vacuum port open to said chamber and an exhaust port open to said vacuum port, valve means on said output means for normally closing said exhaust port, said tube being movable by said control member to a first position where said open end seats on and is closed by said valve means while said valve means continues to close said exhaust port, said tube being further movable by said control member in one direction from said first position to a second position where said open tube end unseats from said valve means to open said open tube end and thereby said vacuum chamber to said vacuum passage via said vacuum port and said tube interior and said tube port, and said tube being further movable by said control member in a direction opposite said one direction from said first position to a third position where said tube moves said valve means to open said exhaust port and thereby said chamber to atmosphere via said vacuum port while said valve means continues to close said open tube end.

2. A vacuum operated actuator comprising a housing, a diaphragm open on one side to the atmosphere and sealingly connected to said housing and cooperating therewith to define a chamber on the other side of said diaphragm, output means fixed to said diaphragm for movement therewith and extending outwardly of said housing, a tube slidably mounted in a bore extending through said output means, said tube having an open end and a closed end, a manually operable control member fixed to said closed end for remotely effecting movement of said tube in said bore, said output means having a vacuum passage adapted to be connected to a vacuum source, a port in said tube intermediate said closed and open ends opening said vacuum passage to the interior of said tube and thereby to said open end, spring means for normally holding said diaphragm and thereby said output means in a non-activated position, said output means having a vacuum port open to said chamber and an exhaust port open to said vacuum port, valve means on said output means for normally closing said exhaust port, said tube being movable by said control member to a first position where said open end seats on and is closed by said valve means while said valve means continues to close said exhaust port, said tube being further movable by said control member in one direction from said first position to a second position where said open tube end unseats from said valve means to open said open tube end and thereby said vacuum chamber to said vacuum passage via said vacuum port and said tube interior and said tube port, and said tube being further movable by said control member in a direction opposite said one direction from said first position to a third position where said tube moves said valve means to open said exhaust port and thereby said chamber to atmosphere via said vacuum port while said valve means continues to close said open tube end.

3. A vacuum operated actuator comprising a housing, a diaphragm open on one side to the atmosphere and sealingly connected about an outer periphery thereof to said housing and cooperating with said housing to define a chamber on the other side of said diaphragm, output means fixed to the center of said diaphragm for movement therewith and extending outwardly of said housing, a tube slidably mounted in a bore extending centrally through said output means, said tube having an open end and a closed end, a manually operable control member fixed to said closed end for remotely effecting movement of said tube in said bore, said output means having a vacuum passage adapted to be connected to a vacuum source, a port in said tube intermediate said closed and open ends opening said vacuum passage to the interior of said tube and thereby to said open end, spring means for normally holding said diaphragm and thereby said output means in a non-activated position, said output means having a vacuum port open to said chamber and an exhaust port open to said vacuum port, valve means on said output means for normally closing said exhaust port, said tube being movable by said control member to a first position where said open end seats on and is closed by said valve means while said valve means continues to close said exhaust port, said tube being further movable by said control member in one direction from said first position to a second position where said open tube end unseats from said valve means to open said open tube end and thereby said vacuum chamber to said vacuum passage via said vacuum port and said tube interior and said tube port, said tube being further movable by said control member in a direction opposite said one direction from said first position to a third position where said tube moves said valve means to open said exhaust port and thereby said chamber to atmosphere via said vacuum port while said valve means continues to close said open tube end, whereby on movement of said tube by said control member from said first position to said second position said chamber is opened to said vacuum passage to evacuate said chamber to allow atmospheric pressure acting on said diaphragm to move said diaphragm and thereby said output means against said spring to follow said tube until said valve means closes said open tube end in addition to closing said exhaust port and whereby on movement of said tube by said control member from said first position to said third position said chamber is opened to atmosphere to allow said spring to move said diaphragm and thereby said output means to follow said tube until said valve means again closes said exhaust port in addition to closing said open tube end.

* * * * *